United States Patent [19]

Drinkard, Jr. et al.

[11] 3,957,601

[45] May 18, 1976

[54] ELECTROCHEMICAL MINING

[75] Inventors: William F. Drinkard, Jr., Charlotte; Henry S. Brown, Raleigh, both of N.C.

[73] Assignee: Mineral Research & Development Corporation, Charlotte, N.C.

[22] Filed: May 17, 1974

[21] Appl. No.: 470,808

[52] U.S. Cl. ..... 204/105 R; 204/107; 204/109; 204/113; 204/117; 204/118

[51] Int. Cl.[2] ..... C25C 1/12; C25C 1/06; C25C 1/16; C25C 1/20

[58] Field of Search ..... 204/106–108, 204/109, 117–118, 122, 115, 111, 113, 105 R

[56] References Cited

UNITED STATES PATENTS

| | | | |
|---|---|---|---|
| 556,092 | 3/1896 | Frölich | 204/111 |
| 636,321 | 11/1899 | Craney | 204/108 |
| 822,175 | 5/1906 | Nolcott | 204/105 R |
| 2,646,396 | 7/1953 | Dean | 204/281 |
| 2,761,829 | 9/1956 | Dolloff | 204/106 |
| 3,616,277 | 10/1971 | Adamson et al. | 204/10 |

FOREIGN PATENTS OR APPLICATIONS

| | | | |
|---|---|---|---|
| 14,353 | 7/1964 | Japan | 204/281 |
| 910,844 | 9/1972 | Canada | 204/281 |

OTHER PUBLICATIONS

"Modern Electroplating" by F. A. Lowenheim, 2nd Ed., 1963, p. 737.

"Theoretical and Applied Electrochemistry" by Thompson, Revised Ed., 1925, p. 216.

"Modern Electroplating" by F. A. Lowenheim, 2nd Ed., 1963, p. 34.

*Primary Examiner*—R. L. Andrews
*Attorney, Agent, or Firm*—Herbert M. Adrian, Jr.

[57] ABSTRACT

A method for the direct extraction of metal values from subterranean sulfide ore deposits is described utilizing electrochemical techniques. The method eliminates the physical digging and crushing of ore. The process can be controlled to extract only the metal values and other useful chemicals from the earth deposit, thus reducing waste disposal and environmental pollution problems. The prior art difficulty with polarization of the electrodes is overcome by utilizing electrolytes of high halogen ion content, thus eliminating insulating sulfur buildups and permitting economical usage of higher current densities.

17 Claims, 1 Drawing Figure

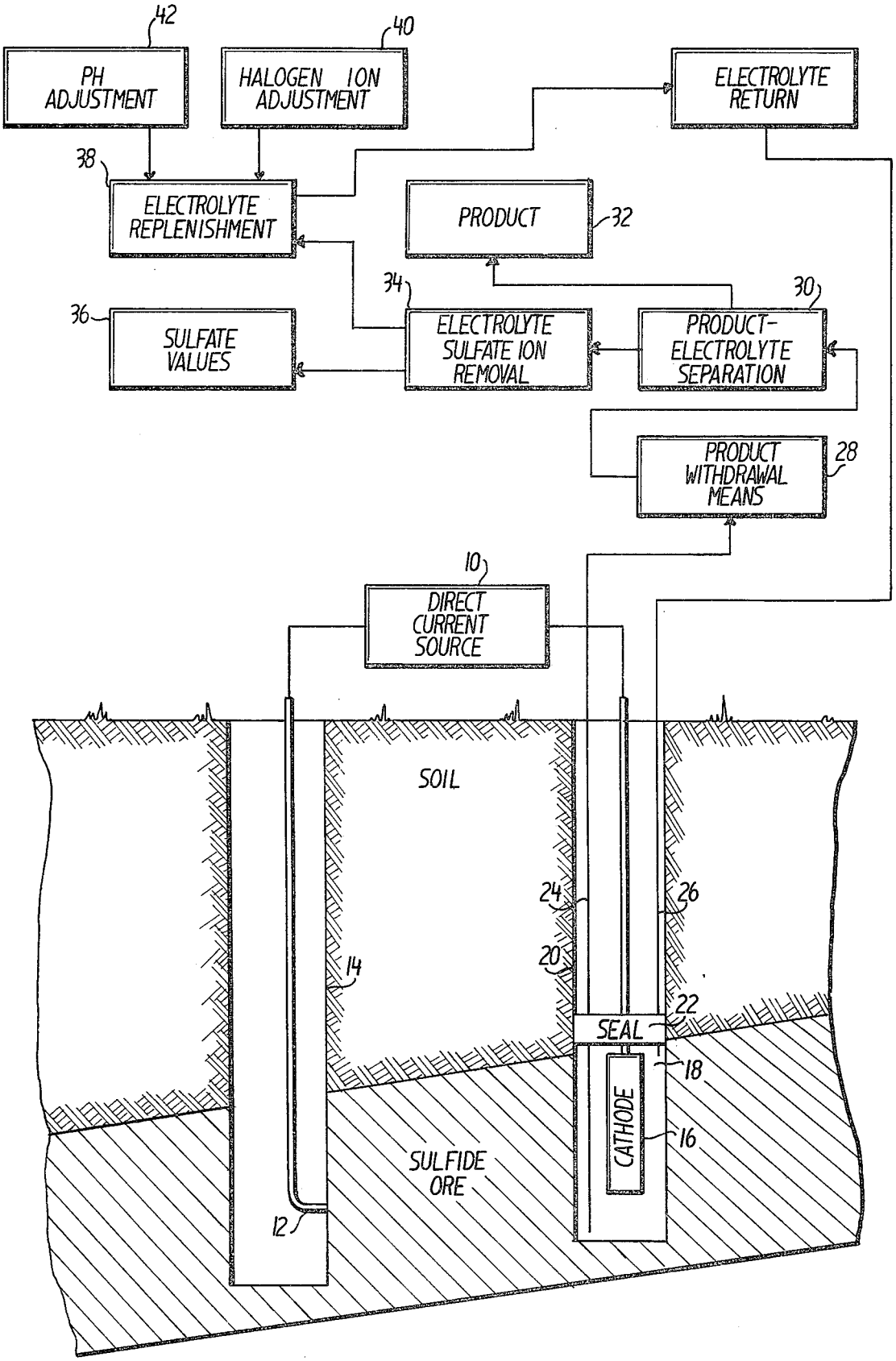
42
PH ADJUSTMENT
40
HALOGEN ION ADJUSTMENT
ELECTROLYTE RETURN
38
ELECTROLYTE REPLENISHMENT
PRODUCT
32
34
30
36
SULFATE VALUES
ELECTROLYTE SULFATE ION REMOVAL
PRODUCT-ELECTROLYTE SEPARATION
PRODUCT WITHDRAWAL MEANS
28
10
DIRECT CURRENT SOURCE
SOIL
24
26
20
14
22
SEAL
18
CATHODE
16
SULFIDE ORE
12

ELECTROCHEMICAL MINING

INTRODUCTION

This invention relates to the electrochemical mining of sulfide ores from earth deposits and more particularly to the strategic placing of electrodes in sulfide ore deposits and utilizing specific electrolytes and decomposition voltages to separate the metal values from the sulfide ores and extract the same from the earth deposit.

BACKGROUND OF THE INVENTION

It has previously been suggested to directly mine metal values from sulfide ores. While theoretically the idea is quite feasible from an engineering standpoint, previous attempts to accomplish such electrochemical mining met with limited success. Initially, the reaction would proceed as theorized, but after only a relatively short application of electric current to the ore body, the electrodes would polarize due to the buildup of an insulating shield of sulfur on the surface of the ore. Current efficiencies would rapidly deteriorate and the electrolysis would slow to an unacceptable rate. Continued application of electrical energy would soon result in total polarization of the electrodes and termination of the electrolysis.

Attempts to overcome this problem have been previously made. It has been suggested that the sulfur buildup and consequent polarization could be eliminated by heating the electrolyte solution to a temperature in excess of the melting point of the sulfur, i.e. above 119 degrees centigrade, thereby melting and extracting the sulfur being built up by a Frasch type process, Such a process, of course, has its obvious shortcomings and difficulties. More particularly, the necessity for maintaining high temperatures below the earth's surfaces with the consequent heat loss places a substantial economic burden on the process with only a very limited return. More elaborate heating and sealing means are required, and these present real engineering and economic difficulties. While such difficulties can be overcome, they are only done with substantial increases in cost, the value of which cannot be justified by the relatively limited sulfur values which can thus be recovered. The sulfur thus recovered cannot compete economically with sulfur conventionally mined by the Frasch process.

Various electrolytes have also been suggested for use in previous attempts to directly recover metals from earth deposits by electrolytic processes. It is recognized that as in any electrolytic process, a conductive solution is required. In the electrolysis of sulfide ores, once the electrolysis is initiated with a conductive electrolyte solution, various salt forming ions enter the electrolyte thus changing the electrolyte composition and forming electrolytes of various concentrations of sulfate and metal ions. As such, it was previously suggested to form the initial electrolyte with sulfate salts or any of the various other inexpensive conductive salts including sodium chloride. Such electrolytes, while useful for initiating the electrolysis, failed to insure continuation of the electrolysis and soon resulted in polarization of the electrodes.

It is an object of the present invention to provide a means for the direct mining of sulfide ore deposits from subterranean ore bodies by electrochemical techniques.

It is a further object of the present invention to provide a method which eliminates polarization of electrodes due to sulfur buildup.

It is another object of the present invention to provide an economical method for the recovery of metal values directly from subterranean sulfide deposits at higher current densities, at economically feasible commercial rates and on a long term basis.

Yet another object of the present invention is to provide an electrochemical process for the mining of sulfide ores which eliminates waste disposal problems, surface water pollution, air pollution and other environmental contamination normally associated with the mining of sulfide ores.

Yet a further object of the present invention is to provide a process for the electrochemical mining of metal values which provides flexability in extracting metal values in a variety of alternatives which can be applied to yield metal values directly as metals or as commercially usable metal salts.

These and other objects of the present invention will become readily apparent to those skilled in the art from the description of the invention which follows.

THE INVENTION

In accordance with the invention, a method is provided for the direct extraction of metal values from earth deposits of sulfide ores comprising attaching a positive source of direct current to a conductive deposit of sulfide ore to form an anode, contacting said deposit with a halogen salt containing electrolyte, positioning a cathode in said electrolyte, passing a decomposition voltage from said anode to said cathode to decompose said anode, said electrolyte having a pH of less than about 5 and a halogen ion concentration of at least about 1 molar and recovering the metal values formed at said cathode.

The process is particularly applicable to the recovery of valuable metals as found in sulfide ores such as nickel, gold copper, silver, palladium, iron, lead, cobalt and the like as described more fully hereinafter. The present process eliminates the need to bring ore deposits to the earth's surface and the additional processing steps often used in conventional mining such as crushing, acid leaching, concentration of ore and the like. Because the process can be controlled to bring only the useful products to the earth's surfaces, waste disposal is eliminated as well as contamination of surface waters in the washing or leaching of ores. Noxious fumes are not emitted such as is the case with conventional sulfide ore smelting wherein sulfur dioxide fumes may be conventionally vented to the atmosphere.

DETAILS OF THE INVENTION

The invention will be more fully understood by reference to the drawing which is a flow sheet and schematic view of the subterranean electrochemical mining of a sulfide ore deposit in accordance with the present invention.

Referring more particularly to the drawing, a source of direct electrical current 10 is connected by means of the conductor 12 to a subterranean sulfide ore deposit. The ore deposit thus becomes the anode when direct current is applied. The source of direct current is best attached to the sulfide ore deposit by means of conductor well or shaft 14 penetrating into the ore body. Such well or shaft need only expose ore so that conductor 12 can be introduced into the ore body. If the ore is near the earth's surface, the exposed ore can be attached directly without a well or shaft.

The negative terminal of the direct current source 10 is connected to cathode 16 which is submerged in electrolyte solution 18 in contact with the sulfide ore deposit. This is preferably accomplished by the sinking of a second vertical shaft or well 20 a preselected distance away from the anode conductor 12.

The distance between anode attachment and the cathode can vary greatly because many sulfide ore deposits are highly conductive and very little energy loss is encountered even with widely separated anode attachment and cathode placement. With less conductive sulfide deposits as may be encountered under certain geological conditions, the anode attachment can be positioned in close proximity to cathode such as within a few yards. For most sulfide deposits, however, the anode attachment can be as far away as the extremities of the deposit, i.e. hundreds of yards away from the cathode placement.

Vertical well 20 is sealed preferably at the beginning of the ore body such as at seal 22 to thereby contain electrolyte 18. Product withdrawal means 24 and electrolyte return means 26 are provided such as via nonconductive pipes, i.e. plastic pipes. In the operation of the process, a decomposition voltage is applied between the anode (the ore body) and cathode 16 thus decomposing sulfide ore in contact with electrolyte 18. Electrolyte and metal values are withdrawn via pipe 24 by means of product withdrawal means 28. Product withdrawal means can conveniently be conventional pumping means such as a suction pump, displacement pump or the like liquid circulating means. The withdrawn product and the electrolyte is then separated 30 with the metal values being removed as product.

Many sulfide ore deposits contain more than one metal which is desirably recovered. Therefore, in productelectrolyte separation 30, more than one metal may be isolated from the solution. For instance, several widely found sulfide ores contain both copper and iron in varying proportions. Electrolysis conditions can be controlled to yield the metal values as ions in solution, one or both metals as finely divided free metal or mixtures of free metals. Metal value separation and isolation into relatively pure form of each metal can be effected by filtration,, decanting, passing over scrap iron to precipitate copper, pH change, flotation, magnetic separation and the like. Properly selected physical and chemical manipulative steps such as these will yield the relatively pure metals and/or salts thereof.

The electrolyte contains sulfate ions and under certain conditions some particulated sulfur. The sulfur and sulfate values are preferably removed in a sulfate removal step 34. The sulfate values 36 are readily recovered and form commercially usable and salable by-products.

The electrolyte 38 is replenished as needed by the addition of halogen ion 40 and pH adjustment 42. The replenished electrolyte is then returned via pipe 26 to the electrolysis. The pH adjustment normally requires the addition of acid to maintain the desired low pH.

The sulfide ores upon which the present invention is most applicable are those electrically conductive sulfide ores containing metals of groups IB, IIB, IVA, VA, VIB and VIII of the Periodic Chart of Elements as shown in *Lange's Handbook of Chemistry*, Eighth Edition, pages 56 and 57. In particular, metals most frequently found in sulfide ores such as copper, nickel, iron, lead, palladium, silver, cobalt and cadmium are recovered by the present process. To effect the present process, the sulfide ores must be conductive and, thus, those few sulfide ores which do not possess electrical conductivity cannot be practically mined in accordance with the present invention. In particular, the present mining method is most useful with sulfide ore deposits containing such minerals as chalocopyrite, galena, pentlandite, pyrite, cobaltite, chalcocite, bornite, niccolite, pyrrhotite and the like which are the more common and widely found sulfide ore deposits.

The electrolyte utilized in the electrolysis contains at least 1 molar amount of halogen up to the saturation point of the halide at the operating temperatures. The halide ion is added preferably as an alkali metal, alkalineearth metal salt or acid thereof and mixtures of salt and acid. Thus, the molar concentration referred to is that of the salt and/or acid. While all of the various halides including chloride, bromide, fluoride, and iodide can be used, as a practical matter only the chloride is normally economically feasible. Of the chloride salts, sodium chloride is the most preferred although lithium chloride, potassium chloride, calcium chloride, magnesium chloride, barium chloride and the like can be used with correspondingly good results. The particular choice of halide salt rests largely on economical considerations and the availability of the salt at the particular mining site. In addition to utilizing a halide salt to achieve the desired halogen ion concentration in the electrolyte, the corresponding halide acid can be used to increase the halide ion content while acidifying the electrolyte to the desired pH. Thus, when utilizing chloride as the halogen, hydrochloric acid is preferably used to adjust the pH to the desired level.

The concentration of halogen ion in the electrolyte requires at least a 1 molar concentration up to the saturation point of the halide. Such concentrations are often measured in terms of Baume which means that the electrolytes of the present process are at least 6 Be. It is preferred that the electrolyte be at least 10 Be, with the most preferred electrolytes being in the range of 15 to 23 Be. With sodium chloride, this represents a solution having a preferred molar concentration of 2 to 4 molars, it being recognized that the addition of acid such as hydrochloric acid will increase the Be particularly with the lower salt concentrations.

Concentrations below about 1 molar, while effective in initiating electrolysis, will not sustain electrolysis beyond a period of several hours without resulting in polarization. On the other hand, while a saturated electrolyte solution may in some instances be desirable, it should be recognized that various other ions particularly sulfate and metal values will be going into the electrolyte solution on the continuation of electrolysis. Thus, unless a correspondingly high electrolyte circulation is maintained or other compensating factors used, precipitation of certain ions or salts may occur as the electrolysis continues. Under certain circumstances, such precipitation is desirable provided the precipitate is an ion which is desirably removed from the electrolyte as the reaction proceeds. It should further be recognized that in such subterranean electrolysis ground water dilution of the electrolyte can and often does occur, thus making it desirable to utilize more concentrated electrolytes so as to maintain the most desired concentration in the electrolysis environment.

The acidity of the electrolyte is adjusted to below a pH of about 5. This is preferably accomplished by addition of the corresponding halide acid such as hydrochloric acid. However, any of the various other strong acids such as sulfuric acid and the like can be used with correspondingly good results. The acidity can range down to a pH of less than 1, i.e. as low as about a pH of 0.01. While such low pH's are useful as electrolyte feed to the electrolysis area where ground water leakage tends to dilute the acidity, the more preferred pH is in the range of about 1.5 to 3.5.

The electrolysis can be carried out at temperatures ranging from that of the sulfide ore, i.e. ambient temperature, up to the boiling point of the electrolyte. However, it is preferred to allow the electrolyte to seek its own temperature recognizing that heat will be generated by the electrical input and, thus, no heating or cooling is necessary. It is further recognized that higher electrolysis temperatures such as those in the range of about 40° to 90°C improve current efficiencies. Therefore, temperatures in this range are preferred and are readily sustained in the electrolysis if desired.

The cathode is constructed of conventional cathode material including graphite, iron, titanium and the like recognizing that the application of current to the cathode produces a cathodic protection thereby reducing corrosion while the electrolysis is being effected. As such, any conductive material could be used as the cathode. Of course, it is preferred to design the cathode to maximize the surface area so as to yield the highest electrolysis rate for a given cathode.

While it is feasible to use any conductive material for the cathode, certain materials provide better cathodes than others. For instance, a cathode material to which free metal will not firmly adhere will yield the metal as finely divided precipitate which can be removed with the circulating electrolyte. Other cathode materials on which metal will plate are useful but will require periodic removal from the electrolysis to remove accumulated metal. Therefore, such cathode materials are best selected from their ease in removal of metal therefrom. Yet a more preferred cathode is one which corresponds to the metal being plated. When a sufficient metal accumulation is reached, the cathode is merely replaced and the former cathode yields the metal product in substantially pure form.

Attachment of the conductor to the sulfide ore should, be effected to maximize electrical conductivity to the ore and minimize deterioration of the contact point.

The cathode is preferably sealed to enclose the electrolysis within a given area. Sealing means further reduces ground water dilution and limit the electrolysis to the area occupied by the electrolyte. The sealing means is adapted to provide sealed openings for the electrolyte circulatory means.

The decomposition voltage applied is preferably maximized to provide economical current efficiencies with the most rapid decomposition of the sulfide ore and recovery of metal values. The particular current density utilized can be varied depending upon the desirablity of recovering free metals or recovering the metal values from the electrolyte solution. In general, the electrolysis is carried out by applying as high a current density as can be economically maintained such that the ore is rapidly decomposed. The metal values are thus generated both as free metal and as ions in the electrolyte solution. Such current densities can vary from about 0.05 to 1 or more amperes per square centimeter and more preferably on the range of 0.1 to about 0.6 amperes per square centimeter.

In carrying out the electrolysis in the preferred ranges specified herein, electrolyte is continuously or periodically withdrawn and replenished while the electrolysis is maintained continuously. The withdrawn electrolyte will contain metal particles if a nonadhering cathode is use, some sulfur particles with the remaining metal and sulfate values being in solution. Where copper is the metal preferably being recovered, the free copper need only be filtered or decanted from the electrolyte and the remaining electrolyte solution passed over scrap metal to precipitate the copper in solution. The withdrawn electrolyte will normally contain a buildup of sulfate ions and other metal ions such as ferrous and ferric ions or whatever other metals are present in sulfide ore. The sulfate ions are readily removed from solution by precipitation with lime, calcium carbonate or calcium hydroxide. The iron in turn is readily removed by increasing the pH to above about 7 and precipitating it as ferric and ferrous hydroxide.

Alternatively, when electrolyzing sulfide ores such as chalocopyrite which contains both copper and iron, both metals can be recovered as free metals by setting the electrolysis conditions for the plating of iron. Such conditions result in both copper and iron being plated on the cathode. By utilizing a nonadhering cathode, the metals formed will flake from the cathode as finely divided metal particles. The finely divided particles are then recovered by the pumping action of the electrolyte. Alternatively, the cathode can be periodically removed as noted above.

While reference has been made more particularly to an electrolysis operation as set forth in the drawing, such reference exemplifies but one preferred method of operation. It will be recognized that economical commercial operations would utilize a plurality of cathodes and shafts or wells into the sulfide ore body so as to maximize the electrolysis being effected at a given site. A single anode contact with the ore is normally sufficient to carry out electrolysis with numerous cathode shafts in the same sulfide ore vein.

The following examples illustrate certain preferred embodiments of the present invention. Unless otherwise indicated, all parts and percentages used herein are by weight and all temperatures in the examples and claims are in degrees centigrade.

EXAMPLE 1

The process of the present invention was carried out in the Piedmont section of North Carolina by drilling vertical shafts into a sulfide ore body comprised of pyrite ($FeS_2$) and chalocopyrite ($CuFeS_2$). A conductor was attached in one vertical shaft to the sulfide ore body to form an anode of the sulfide ore body. A second vertical shaft for the cathode was drilled several yards away. A lead cathode was placed in the center of the second vertical shaft and the outlet end sealed to form a watertight compartment as shown in the drawing. Electrolyte feed means and withdrawal means were located so as to circulate electrolyte to and from the electrolysis area.

Electrolyte comprising 18Be sodium chloride adjusted with hydrochloric acid to a pH of less than 2.0 was fed into the cathode chamber. A decomposition voltage of direct current was applied between the sulfide ore body anode and the cathode for a total period of approximately 790 hours. The average current density was 0.3 amperes per square centimeter. Electrolyte solution was periodically withdrawn and replenished with electrolyte adjusted to 18 Be sodium chloride at a pH of less then 2.0. Free metallic copper and copper salts were present in the withdrawn electrolyte solution. The finely divided free copper was separated by filtration and the copper in solution recovered from the electrolyte.

While in the above-described example it was desirable merely to recover the copper, the iron and sulfur are also readily recoverable. The copper in solution is precipitated by passing the solution over scrap iron and the sulfate subsequently removed by liming the solution. The iron values are then readily precipitated by increasing the pH of the solution to above about 7 to precipitate ferrous and/or ferric hydroxide.

In the same manner lead, nickel, cobalt, tin, silver and the like metals of groups IB, IIB, IVA, VA, VIB and VIII of the Periodic Table can be recovered from sulfide ore deposits with correspondingly good results.

EXAMPLE 2

The electrolysis of sulfide ores was attempted utilizing more dilute solutions of a halogen containing electrolyte. In particular, electrolytes having a pH of 2.5 and a Be of 1, 2, 3 and 4 were utilized in electrolyzing pyrrhotite. The electrolysis was commenced at a current density of about 0.3 amperes per square centimeter. After a period of time ranging from about 2 hours to several hours, polarization of the electrodes caused a substantial reduction in current efficiencies and finally terminated effective electrolysis. The time period required to polarize the electrodes was proportional to the solution strength with lower Be solutions causing shorter electrolysis prior to polarization.

Utilizing a sodium chloride solution of 6 Be or more, long term electrolysis is continued without polarization.

While the process described herein will normally be used on land masses, the process is readily also used beneath lakes and seas such as below the floor of the ocean.

While there have been described more particularly the preferred embodiments of the present invention, particularly with respect to recovery of copper and utilization of sodium chloride electrolytes, it will be readily recognized by those skilled in the art that various other halogen electrolytes and metals described herein can be recovered in the same manner with correspondingly good results. As such, it is intended to cover the invention broadly being limited only by the following claims.

What is claimed is:

1. A method for the direct extraction of metal values from eath deposits of sulfide ores comprising attaching a positive source of direct current to a conductive deposit of sulfide ore to form an anode, contacting said deposit with a halogen salt containing electrolyte, positioning a cathode in said electrolyte, passing a decomposition voltage from said anode to said cathode to decompose said anode, said electrolyte having a pH of less than about 5 and halogen ion concentration of at least about one molar.

2. The method of claim 1 wherein the halogen is chloride.

3. The method of claim 2 wherein the halogen salt is sodium chloride.

4. The method of claim 2 wherein the halogen salt is calcium chloride.

5. The method of claim 1 wherein the initial electrolyte concentration of halogen salt is in an amount of about 1 molar up to just below the saturation point at the operating temperature.

6. The method of claim 5 wherein the electrolyte concentration of halogen salt is between 2 and 4 molars.

7. The method of claim 1 wherein electrolyte is continuously or periodically withdrawn from the electrolysis, metal values removed, electrolyte halogen ion concentration and pH adjusted and returned to the electrolysis.

8. The method of claim 7 wherein the cathode deposit contains copper and the withdrawn electrolyte is passed over scrape iron thereby depositing copper therefrom and subsequently liming the electrolyte to precipitate sulfate.

9. The method of claim 7 wherein the cathode is enclosed in a catholyte compartment and said electrolyte is withdrawn from the bottom of said catholyte compartment to thereby withdraw catholyte precipitate with said electrolyte.

10. The method of claim 7 wherein the sulfide deposit contains copper and iron, the cathode is comprised of titanium and wherein the decomposition voltage is maintained for the plating of iron on said cathode thereby forming free copper and iron on said cathode, said free metals being collected in said catholyte compartment and removed with electrolyte.

11. The method of claim 1 wherein the electrolysis is conducted at an electrolyte temperature in the range of from ambient to just below the boiling point of the electrolyte.

12. The method of claim 1 wherein the current density is within the range of 0.1 to 1.0 amperes per square centimeter.

13. The method of claim 1 wherein the cathode is comprised of titanium.

14. The method of claim 1 wherein the cathode is of the same metal as that contained in the sulfide ore.

15. The method of claim 1 wherein the sulfide ore contains a metal of group IB, IIB, IVA, VA, VIB or VIII of the Periodic Chart of Elements.

16. The method of claim 1 wherein the sulfide ore is chalcopyrite, galena, pentlandite, pyrite, cobaltite, chalcocite, bornite, niccolite or pyrrhotite.

17. The method of claim 1 wherein the electrolyte solution is 15 to 23 Baume sodium chloride at a pH of 1.5 to 3.5.

* * * * *